US006338311B1

(12) United States Patent
Ho

(10) Patent No.: US 6,338,311 B1
(45) Date of Patent: Jan. 15, 2002

(54) TELESCOPIC ROADBLOCK

(76) Inventor: Hoi Kwok Ho, Flat G, 21/F Block 8 Tuen Mun Town Plaza 2 Tuen Yan Street, Tuen Mun N T (HK)

( * ) Notice: Subject to any disclaimer, the term of this patent is extended or adjusted under 35 U.S.C. 154(b) by 0 days.

(21) Appl. No.: 09/429,640

(22) Filed: Oct. 29, 1999

(30) Foreign Application Priority Data

Oct. 30, 1998 (CN) ..... 98243285

(51) Int. Cl.[7] ..... E01F 9/00

(52) U.S. Cl. ..... 116/63 C; 256/13.1; 256/1; 404/10

(58) Field of Search ..... 256/1, 13.1, 19, 256/DIG. 2; 404/9, 10; 116/63 R, 63 C, 63 P

(56) References Cited

U.S. PATENT DOCUMENTS

| | | | | |
|---|---|---|---|---|
| 2,275,711 | A | * | 3/1942 | Ybanez |
| 2,954,005 | A | * | 9/1960 | Cioffi et al. |
| 3,496,904 | A | * | 2/1970 | Rimkus |
| 3,707,320 | A | * | 12/1972 | Brynes |
| 4,197,807 | A | * | 4/1980 | Campbell |
| 4,256,050 | A | * | 3/1981 | Barnard |
| D327,231 | S | * | 6/1992 | Mazzola |
| 5,305,705 | A | * | 4/1994 | Gagliano |
| D348,412 | S | * | 7/1994 | Hazelton |
| 5,375,554 | A | * | 12/1994 | Yen |
| D358,111 | S | * | 5/1995 | Gregory |
| 5,488,792 | A | * | 2/1996 | Kwok ..... 116/63 C |
| 5,529,429 | A | | 6/1996 | Pelegrin |

FOREIGN PATENT DOCUMENTS

| | | | |
|---|---|---|---|
| CN | 2238263 | Y | 10/1996 |
| CN | 2263135 | Y | 9/1997 |
| GB | 2090625 | A * | 7/1982 |

* cited by examiner

*Primary Examiner*—Lynne H. Browne
*Assistant Examiner*—Tomlyne A Malcolm
(74) *Attorney, Agent, or Firm*—Banner & Witcoff, Ltd.

(57) ABSTRACT

A telescopic roadblock comprises a base and a cone on the base. The cone is of telescopic structure defined by a plurality of inter-linked concentric hard conical sleeves having the same height and decreasing diameters with two adjacent hard conical sleeves being connected together by a soft material, whereby the cone can be easily compressed up to the same height as a hard conical sleeve. The hard conical sleeve with the smallest diameter is set on the topmost end. The outer surface of the cone is coated with reflectorizing material. The roadblock is small, convenient, eye-catching and easy to carry.

20 Claims, 2 Drawing Sheets

TELESCOPIC ROADBLOCK

The present invention relates to a telescopic roadblock.

When one road is in a special period or an automobile needs repairing, a roadblock is usually set to make sure of the safety of other automobiles and pedestrians as well. The conventional roadblock is not eye-catching and in convenient to carry or move because of its big size and weight.

The objective of the present invention is to overcome the above disadventages and provide a roadblock which is small, eye-catching and easy to carry. When it is not in use, it can be folded and put into an automobile. When in use, it can be stretched out and put on the road for safety.

Accordingly, to achieve the above objective, there is provided an telescopic roadblock comprising a base and a cone on the base. The cone is of telescopic structure defined by a plurality of interlinked concentric hard conical sleeves having the same height and decreasing diameters with soft material (4) connecting two adjacent hard conical sleeves together and the hard conical sleeve with the smallest diameter being set on the topmost end.

The present invention is advantageous over the prior art in that soft material is used to connect the hard conical sleeves to form a telescopic cone so that the clasping means for connecting two sleeves is no longer necessary and the roadblock has a simple structure and a small size, and is convenient to carry, operate, maintain and use.

The above objective and advantages of the present invention will become more apparent by describing in detail a preferred embodiment thereof with reference to the accompany drawings in which.

Figure 1:
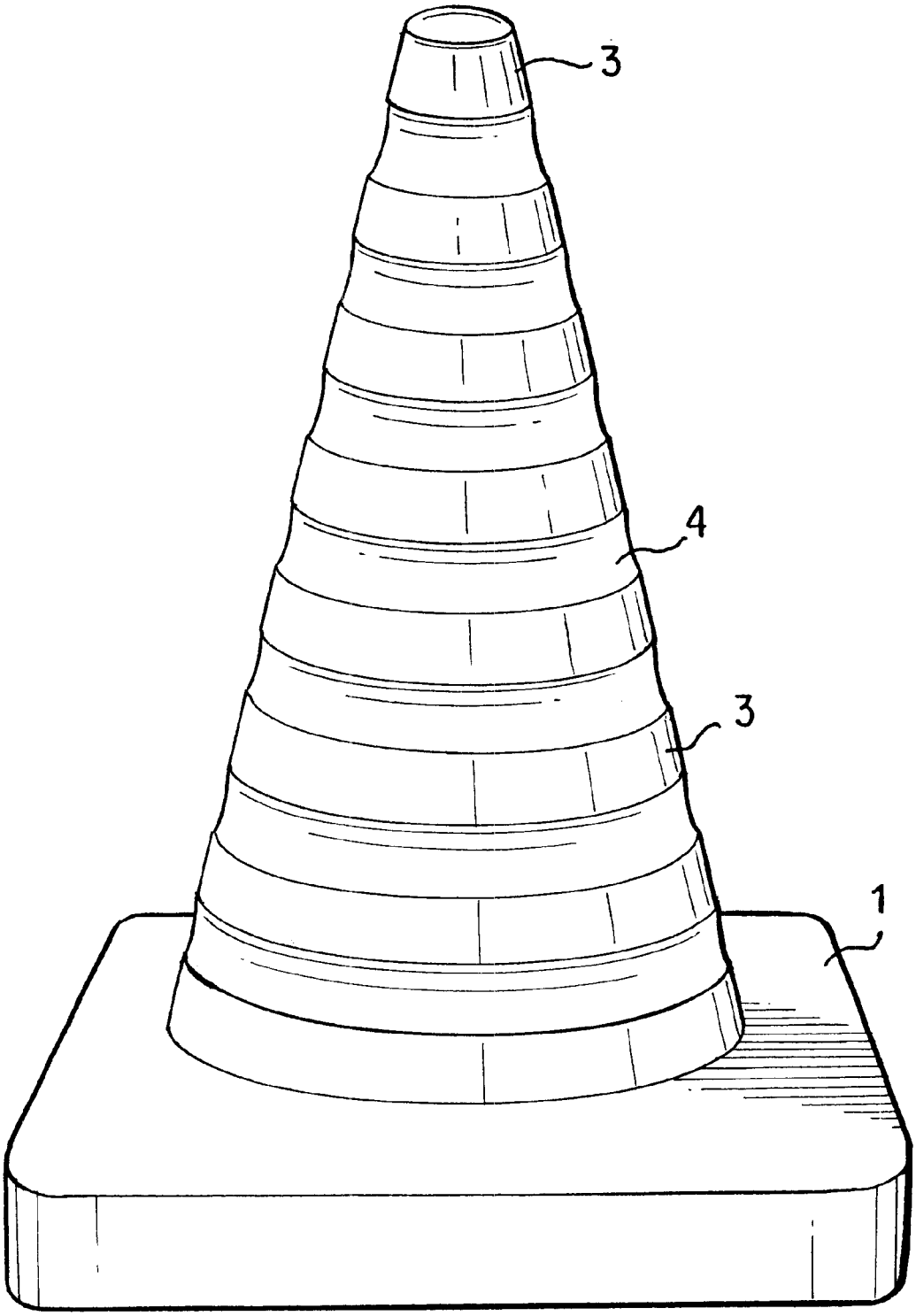
FIG. 1 is a perspective view showing a telescopic roadblock when in use.

Referring to FIG. 1, it is a perspective view showing the structure of a telescopic roadblock comprising an underneath base 1 and a telescopic cone on the base. The cone is of telescopic structure defined by a plurality of inter-linked concentric hard conical sleeves 3 having the same height and decreasing diameters with two adjacent hard conical sleeves 3 being connected by a soft material 4 and the hard conical sleeve with the smallest diameter being set on the topmost end.

The base 1 is made of hard material such as plastics, engineering plastics, wood and so on. The hard conical sleeve 3 is made of plastics, engineering plastics, etc. The soft conical sleeve 4 used to connect the hard conical sleeves is made of canvas, nylon, chemical fiber, plastics, etc.

The first conical sleeve above the base 1 may be the hard conical sleeve 3 or the soft conical sleeve 4 used for connecting.

To make the roadblock eye-catching, reflectorizing material or fluorescent meterial is coated on the outer surface of the roadblock, making it reflecting in sun or light with an eye-catching effect. Therefore, the roadblock can be used in daytime and at night as well.

Not only by coating reflectorizing material on the outer surface of the roadblock, but also by making the hard conical sleeves and the soft conical sleeves with reflectorizing material, can the eye-catching effect be obtained. The reflectorizing cloth material available on the market can be used to make the soft material 4.

The soft material 4 and the hard conical sleeve 3 can be connected by different ways such as adhereing or pin connection.

Figure 2:
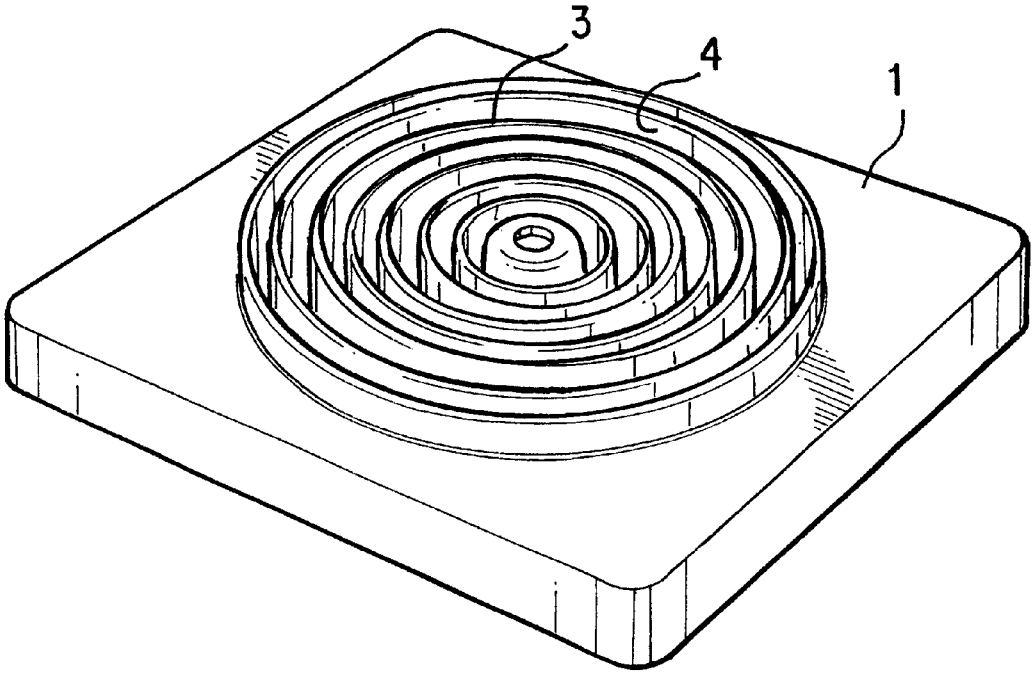
FIG. 2 is a perspective view showing a telescopic roadblock when it is not in use.

FIG. 2 is a perspective view showing a telescopic roadblock when it is not in use. In this case, all the conical sleeves 3 are pressed down one by one. As all the conical sleeves have the same height, the telescopic roadblock can be pressed to the height of one hard conical sleeve 3.

The present invention which is of novel structre is beautiful and practical. When in use, the conical sleeves 3,4 can be pulled out one by one to form a cone. When it is not in use, the conical sleeves 3 and 4 are pressed down one by one. As all the conical sleeves have the same height, the cone can be easily pressed to the height of a hard conical sleeve 3.

Being made of plastics and chemical fiber, the roadblock is convenient for any drivers and road maintenaner.

What is claimed is:

1. A telescopic roadblock comprising a base, an upper end, and a plurality of conical sleeves formed of a first material and spaced from each other along the length of the roadblock between said base and said upper end, each said conical sleeve comprising an upper terminal end, a lower terminal end and an outer diameter that increase from said upper terminal end to said lower terminal end, and a second material extending between adjacent conical sleeves along the length of the roadblock, wherein said second material is softer than said first material.

2. The telescopic roadblock according to claim 1 wherein said conical sleeves are concentric.

3. The telescopic roadblock according to claim 1 wherein said first material is plastic.

4. The telescopic roadblock according to claim 1 wherein said upper terminal end and said lower terminal end of each conical sleeve are spaced by a distance, and wherein said distance is the same for each conical sleeve.

5. The telescopic roadblock according to claim 1 wherein said base is formed of a hard material.

6. The telescopic roadblock according to claim 5 wherein said hard material is a plastic.

7. The telescopic roadblock according to claim 6 wherein said plastic is a light reflective plastic.

8. The telescopic roadblock according to claim 5 wherein said hard material is wood.

9. The telescopic roadblock according to claim 1 wherein said second material is formed of a material from the group consisting of canvas, nylon, chemical fiber and light reflective cloth.

10. The telescopic roadblock according to claim 1 wherein an outer surface of said roadblock is coated with a light reflective material or a fluorescent material.

11. The telescopic roadblock according to claim 1 wherein an outer surface of said second material is coated with a fluorescent material.

12. The telescopic roadblock according to claim 1 wherein said conical sleeves are secured said second material by an adhesive.

13. A telescopic roadblock comprising: a base, an upper end and a plurality of concentric conical sleeves, said conical sleeves being formed of a first material and being spaced from each other along the length of the roadblock by a second material, said second material extending between the spaced conical sleeves and being formed of a material that is softer than said first material.

14. The telescopic roadblock according to claim 13 wherein each said conical sleeve includes has an upper terminal end and a lower terminal end, and an outer diameter that increases between its upper terminal end and its lower terminal end.

15. The telescopic roadblock according to claim 13 wherein said first material is plastic.

16. The telescopic roadblock according to claim 13 wherein an upper terminal end and a lower terminal end of each conical sleeve are spaced by a distance, and wherein said distance is the same for each conical sleeve.

17. The telescopic roadblock according to claim 13 wherein said base is formed of a light reflective plastic.

18. The telescopic roadblock according to claim 13 wherein said second material is formed of a material from the group consisting of canvas, nylon, chemical fiber and light reflective cloth.

19. The telescopic roadblock according to claim 13 wherein an outer surface of said roadblock is coated with a light reflective material or a fluorescent material.

20. The telescopic roadblock according to claim 13 wherein only an outer surface of said second material is coated with a fluorescent material.

* * * * *